US006364241B1

(12) United States Patent
Bartels

(10) Patent No.: US 6,364,241 B1
(45) Date of Patent: Apr. 2, 2002

(54) APPARATUS AND METHOD OF PRODUCING ROLLS OF BAGS

(75) Inventor: Willy Bartels, Mönchengladbach (DE)

(73) Assignee: FAS Converting Machinery, AB, Ystad (SE)

( * ) Notice: Subject to any disclaimer, the term of this patent is extended or adjusted under 35 U.S.C. 154(b) by 0 days.

(21) Appl. No.: 09/384,387

(22) Filed: Aug. 27, 1999

(51) Int. Cl.[7] ..... B65H 19/28; B65H 35/10

(52) U.S. Cl. ..... 242/528; 242/521; 242/531.1; 242/532.7; 242/533.7; 242/547; 242/571.1

(58) Field of Search ..... 242/528, 521, 242/531.1, 532.7, 532, 533.7, 541.3, 541.1, 541.6, 547, 571.1

(56) References Cited

U.S. PATENT DOCUMENTS

| | | | | | |
|---|---|---|---|---|---|
| 789,707 | A | * | 5/1905 | Bellamy | 242/547 |
| 2,157,765 | A | * | 5/1939 | Lanter | 242/547 |
| 2,449,234 | A | * | 9/1948 | Knoble | 242/531.1 |
| 3,847,366 | A | * | 11/1974 | Schmidt et al. | 242/533.7 |
| 3,957,220 | A | * | 5/1976 | Beck et al. | 242/528 |
| 4,000,864 | A | | 1/1977 | Kurtz et al. | |
| 4,034,928 | A | | 7/1977 | McDonald et al. | |
| 4,436,252 | A | * | 3/1984 | Burkle et al. | 242/571.1 |
| 4,757,952 | A | | 7/1988 | Balzer | |
| 4,944,468 | A | * | 7/1990 | Damour | 242/571.1 |
| 5,058,820 | A | * | 10/1991 | Ito et al. | 242/541.3 |
| 5,291,823 | A | * | 3/1994 | Kramps | 242/528 |
| 5,377,929 | A | | 1/1995 | Gietman, Jr. et al. | 242/521 |
| 5,779,180 | A | | 7/1998 | Smedt et al. | 242/528 |
| 5,832,696 | A | * | 11/1998 | Nagy et al. | 242/541.3 |
| 5,979,820 | A | * | 11/1999 | Yamada et al. | 242/541.3 |

FOREIGN PATENT DOCUMENTS

| | | |
|---|---|---|
| DE | 37 42994 A1 | 6/1989 |
| EP | 0 095 790 | 12/1983 |
| EP | 0 837 020 | 4/1998 |
| GB | 2 030 969 | 4/1980 |
| WO | WO 96/15039 | 5/1996 |
| WO | WO 97/33744 | 9/1997 |

* cited by examiner

*Primary Examiner*—John M. Jillions
(74) *Attorney, Agent, or Firm*—Smith, Gambrell & Russell, LLP

(57) ABSTRACT

In an apparatus and a method of producing a roll of bags, a feeding means is arranged to feed bags one by one to a winding station. The winding station includes a rotating spindle which is arranged to engage with each bag separately to wind the bag thereon, thereby building a roll of bags in which the bags are unconnected to one another yet firmly hold together.

The apparatus can be of simple construction, which provides for low costs and little wear and tear. Further, there is little risk of inflicting damage to the bags. Additionally, the flow of separate bags can be directed between several sequentially operated winding stations, thereby allowing for high production rates.

36 Claims, 3 Drawing Sheets

APPARATUS AND METHOD OF PRODUCING ROLLS OF BAGS

FIELD OF THE INVENTION

The present invention relates generally to the art of winding equipment. More specifically, the invention relates to an apparatus and a method of producing rolls of plastic bags, in which the bags are wound into a roll without being connected to one another.

DESCRIPTION OF THE PRIOR ART

Many different types of winding machines are known for winding pliable strips of material such as plastic bags. One type of apparatus is arranged to wind bags into a roll without the bags being connected to one another. In this apparatus, a bag is separated from a continuous web of bag material having perforations in the boundary between adjacent bags. A leading end of the separated bag is arranged to overlap a trailing end of a preceding bag, thereby building a strand of so-called interleaved bags. This strand of bags is then wound into a roll in a winding device.

One such roll-forming apparatus, as disclosed in U.S. Pat. No. 5,377,929, has a tumbler assembly which is arranged intermediate a feeding device and a winding device. The tumbler device is adapted to receive a continuous web of bag material from the feeding device. By rotating the tumbler assembly, a bag is separated from the web and arranged to partly overlap a trailing end of the succeeding web fed from the feeding device. The strand of interleaved bags thus formed is fed to the winding device, in which a roll of bags is formed.

U.S. Pat. No. 4,000,864 discloses a roll-forming apparatus in which a gripping device is arranged intermediate a feeding device and a winding device. The gripping device is adapted to grip the leading edge of a separated bag as received from the feeding device, accelerate the separated bag relative to a preceding bag, decelerate the separated bag and place a leading end of the separated bag on a trailing end of the preceding bag. This operation is repeated to form a strand of interleaved bags which are fed to the winding device.

U.S. Pat. No. 4,034,928 discloses a roll-forming apparatus having a sheet tuck-in means in the form of a blade. In this apparatus, separate bags are fed to the tuck-in means, where a bag is folded by advancing the blade into contact with the bag about midway between its terminal edges. Then a succeeding bag is fed to the tuck-in means, folded and advanced such that it is caught between the terminal edges of the preceding bag. Thus, a strand of interleaved bags is created. This strand is fed to a winding device, in which a roll of bags is formed.

One drawback of the above types of apparatus resides in their inherent mechanical complexity. Thus, the prior-art roll-forming apparatus tends to be expensive, have much down-time and require frequent maintenance. Further, the apparatus often includes a sophisticated control system for adequate timing of the feeding and overlapping operations. Expensive and delicate sensors might also be installed to provide necessary timing signals. Also, the overlapping operation often calls for a periodic and abrupt change in the speed of various feeding mechanisms, leading to increased wear and tear in the machinery.

Other related prior art is disclosed U.S. Pat. No. 5,779,180, WO 97/33744, and DE-A-37 42 994, the latter disclosing a device for producing a stack of plastic bags. The stacking device includes a rotating barrel drum, the periphery of which has a projecting needle. Separated bags are sequentially fed to the barrel drum, where they are threaded onto the projecting needle, thereby creating a stack of overlapping bags on the periphery of the drum. By stopping the drum and retracting the needle, the stack of bags can be transferred to a subsequent discharge device.

OBJECTS OF THE INVENTION

One object of the invention is to solve or alleviate some or all of the above problems associated with the prior art. More specifically, it is an object of the invention to provide a roll-forming apparatus of simple construction, which is capable of winding bags into a roll without the bags being connected to one another and without inflicting any damage to the bags.

Furthermore, the apparatus should exhibit low wear and tear of the included components.

A further object is to provide a roll-forming apparatus with little need for control and timing in the production of rolls of bags.

Still another object is to provide an apparatus allowing for little down-time and high production rates.

An additional object of the invention is to provide an apparatus capable of being included in or operated together with conventional bag-making machines.

Another object of the invention is to provide a method remedying some or all of the drawbacks described above.

SUMMARY OF THE INVENTION

These and other objects and advantages of the invention, which will appear from the description below, are achieved by an apparatus and a method as set forth in the independent claims. Preferred embodiments are defined in the dependent claims.

The invention is based on the understanding that one can dispense with the arranging of the separated bags in an overlapping fashion before winding them into a roll of bags. Instead, the feeding means is arranged to feed bags one by one to the winding station. The winding station includes a rotating spindle which is arranged to engage with each bag, directly or via bags previously wound thereon, to form the roll of bags in which the bags are unconnected to one another yet firmly held together. This allows for considerable simplification in the construction of the apparatus. Since the bags are fed one by one to the winding station, there is no need for tumbling or reciprocating devices manipulating the leading or trailing ends of each bag. Thus, a reduced risk of damage to the bags results, as well as low wear and tear in the construction itself. Further, since the bags are fed one by one to the winding station, it is easy to direct the flow of separate bags between different winding stations. This allows for high production rates since two or more winding stations can be operated sequentially such that a roll of bags is being formed in one winding station while a finished roll of bags is being discharged from an adjacent winding station.

BRIEF DESCRIPTION OF THE DRAWINGS

For exemplifying purposes, the invention will now be described in more detail with reference to the accompanying drawings, which schematically illustrate a currently preferred embodiment of the invention and in which.

DESCRIPTION OF EMBODIMENTS OF THE INVENTION

Figure 1:
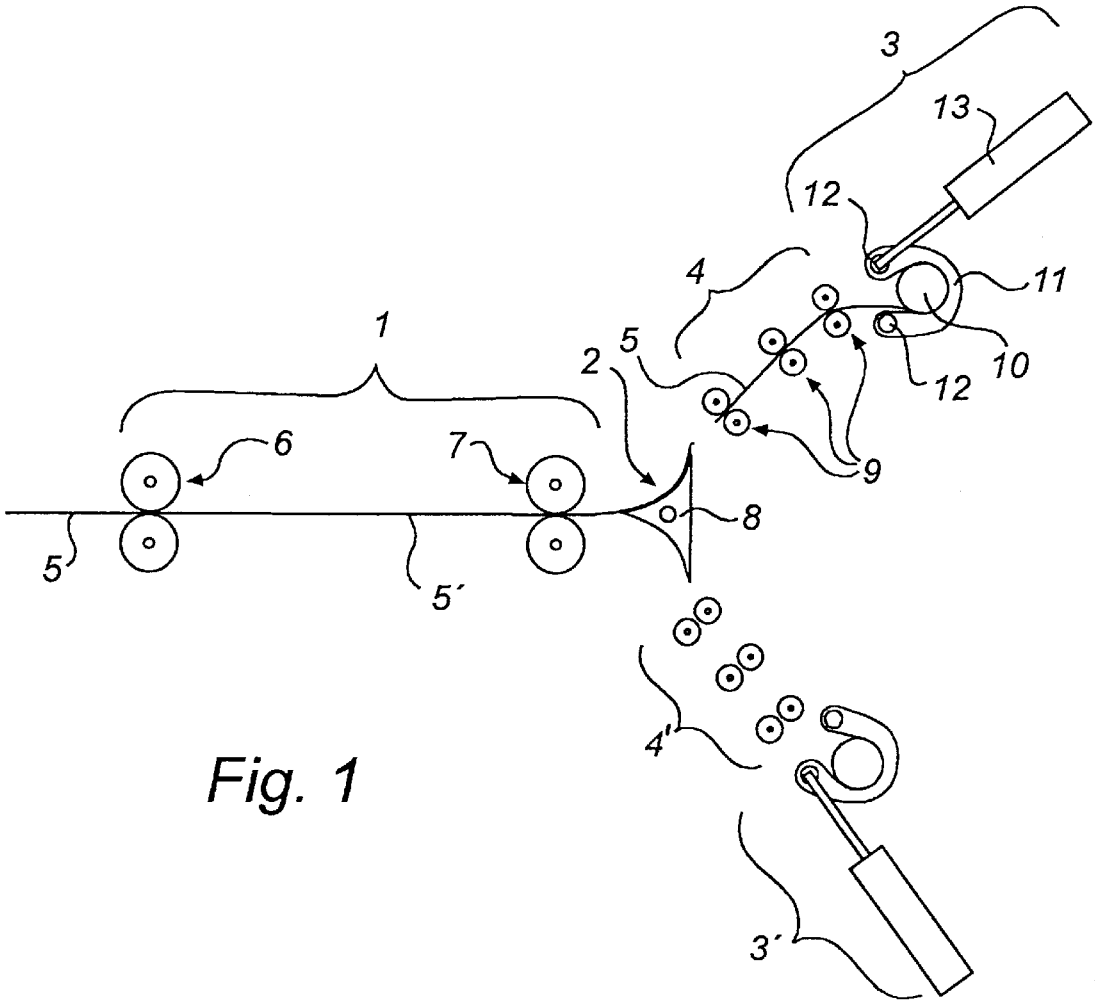
FIG. 1 is a general plan of a bag production apparatus according to one embodiment of the invention.

FIG. 1 provides a schematic overview of an embodiment of an apparatus according to the invention. The apparatus comprises a combined infeed and separation unit 1, a switch unit 2, and first and second winding stations 3, 3'. Between the switch unit 2 and each winding station 3, 3' there is provided a feeding device 4, 4'.

The roll-forming apparatus receives a web 5 of bag material, for example from a bag-making machine. In such a web 5, bags are defined by welding lines and perforations, in a manner known per se.

The infeed and separation unit comprises a driven pair of inlet rollers 6 feeding the web 5 at a first speed. Downstream of the inlet rollers 6, there is provided a driven pair of outlet rollers 7 feeding the web at a second speed, which is higher than the first speed. Thus, when the leading edge of the web is engaged with the outlet rollers 7, the web 5 will be stretched such that a bag 5' is torn from the web 5 along a perforation therein. Thus, separation is achieved without any interruption in the web feeding rate. Further, the separation unit 1 also automatically provides a spacing between each separated bag 5' and the web 5, since the bag 5' is accelerated by the outlet rollers 7. The distance between the inlet and outlet rollers 6, 7 should be adjustable in relation to the length of the bags 5'. Preferably, this distance should equal or exceed the length of each bag 5'.

The switch unit 2 comprises a wedge 8, the tip of which is directed towards the separation unit 1. The wedge 8 is slightly rotatable such that its tip is moved sideways a small distance to guide the flow of separated bags 5' from the separation unit 1 to the first or to the second winding station 3, 3'.

The feeding device 4 comprises a number of sequential pairs of rollers 9, preferably driven at the same feeding rate as the outlet rollers 7 of the separation unit 1.

The winding station 3 comprises a rotatable winding spindle 10. The separated bags 5' are fed one by one to the spindle 10 and are overlappingly arranged on the periphery thereof. Thus, the bags 5' are successively engaged with the spindle 10, on which a roll of bags is built up. A belt 11 is arranged to encircle a major portion of the periphery of the spindle 10 in order to hold the bags 5' against the periphery of the spindle 10. A number of backup rollers 12 are arranged to guide the belt 11 in an endless loop around the winding spindle 10. A belt tensioning device 13 is connected to one of the backup rollers 12. As the number of bags wound onto the spindle 10 is increased, the belt tensioning device 13 adjusts the tension in the belt 11 to be essentially constant so that an essentially constant force is applied to the bags on the spindle 10. In one preferred embodiment with automatic tension adjustment, the belt tensioning device comprises a piston/cylinder arrangement in which the cylinder contains a gas held at a constant pressure. Thus, the gas provides a constant backing pressure producing a force acting on the piston, which in turn is connected to a backup roller 12 in the winding station 3. The second winding station 3' is identical to the first winding station 3 and a detailed description thereof is therefore not necessary.

Figure 2:
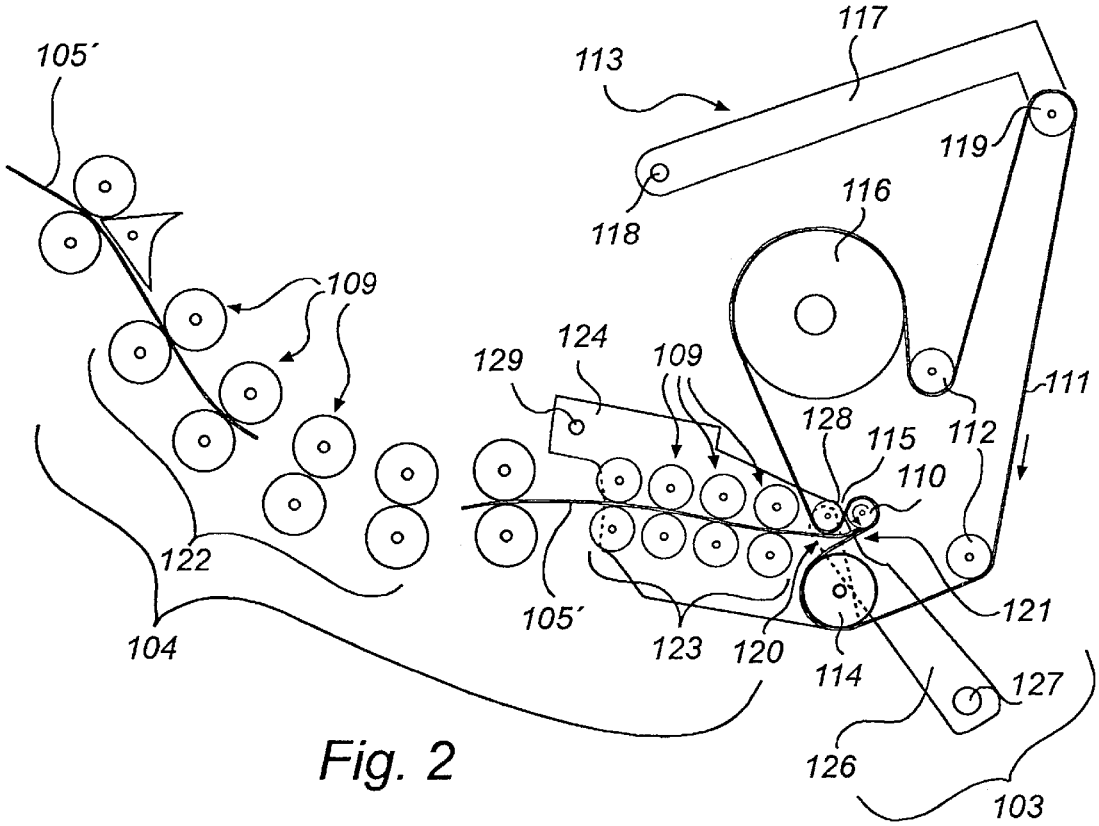
FIG. 2 is an end view of the embodiment shown in FIG. 1, the apparatus being in an initial stage in producing a roll of interleaved bags.
Figure 3:
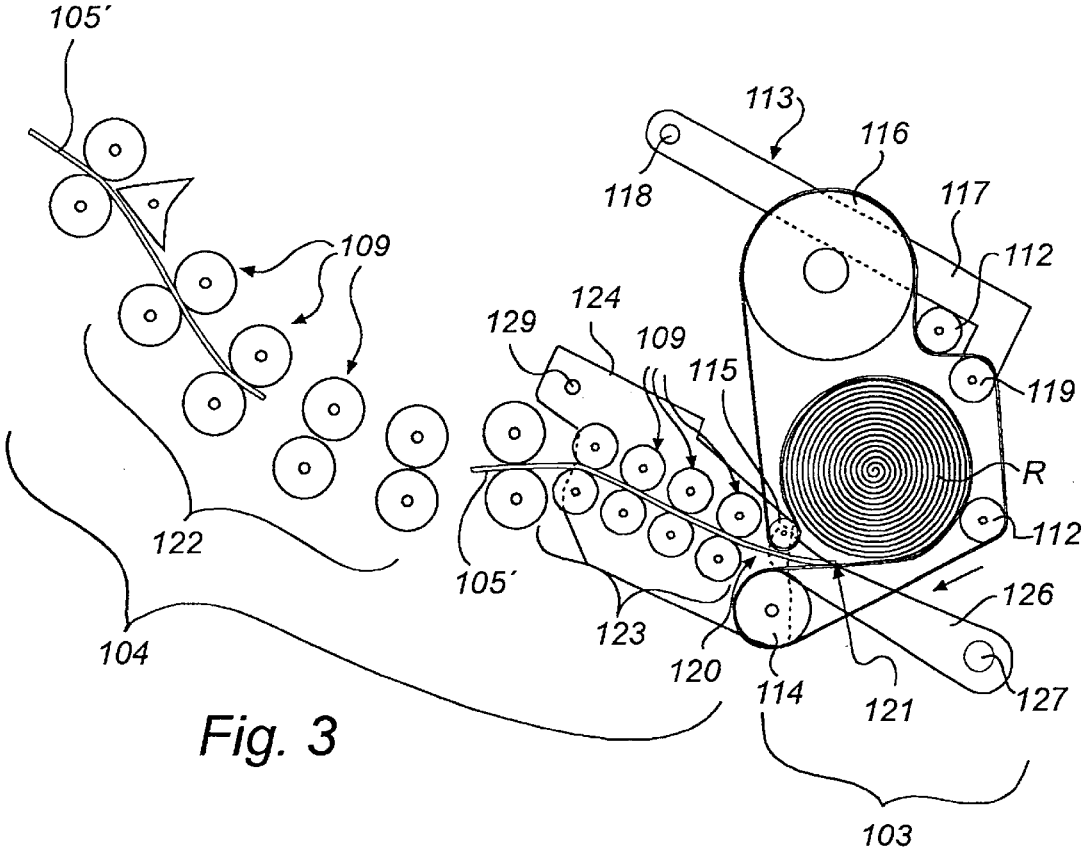
FIG. 3 is an end view of the embodiment shown in FIG. 1, the apparatus being in a final stage in producing a roll of interleaved bags.

FIGS. 2 and 3 show in more detail an embodiment of the winding station 103 and the associated feeding means 104 in an initial and final stage, respectively, in producing a roll R of bags.

The winding station 103 is formed around the rotatable spindle 110. The belt 111, preferably made of a material such as rubber, is arranged in an endless loop extending over a number of backup rollers 112, 114, 115 and a belt guide means 116. Preferably, the surfaces of the belt 111 are flat.

The belt tensioning device 113 comprises a tension lever 117 which is swingable at one end around a pin 118 attached to a frame (not shown) of the winding station 103. At the other end, the tension lever 117 carries a roller 119 which is arranged within the endless loop in contact with the belt 111. The tension lever 117 is connected to a member (not shown) applying tractive forces thereto, such as the piston/cylinder arrangement described above.

The winding station 103 comprises an inlet backup roller 114 and an outlet backup roller 115, with respect to the direction of belt movement around the periphery of the spindle 110. The inlet and outlet backup rollers 114, 115 define an inlet opening 120 through which bags 105' are being fed to the spindle 110. This inlet opening 120 should be as small as possible to assure that the leading ends of the bags 105' follow the periphery of the spindle 110. Therefore, the outlet backup roller 115 has a small diameter. A loop portion 121 extending between the inlet backup roller 114 and the spindle 110 drives the leading edge of each bag 105' into engagement with the spindle 110, or the previous bags 105' wound thereon.

The feeding means 104 comprises first and second feeding assemblies 122, 123, each comprising a number of sequential driven pairs of rollers 109. The second feeding assembly 123 is arranged on a holder 124 together with the inlet and outlet backup roller, 114, 115. A control lever 126 is swingable around a pin 127 attached to the frame (not shown) of the winding station 103. A distal end of the control lever 126 is rotatably attached to a first pin 128 of the holder 124. The outlet backup roller 115 is arranged for free rotation on this first pin 128. The holder 124 has a second pin 129 which is swingably and slidably received in a bearing (not shown) attached to the frame (not shown). The control lever 126 is biased towards the spindle 110 such that the outlet backup roller 115 is always applied to the periphery of the bags 105' being wound on the spindle 110, thereby directing the leading end of the outermost bag around the spindle 110.

The arrangement of the inlet and outlet backup rollers 114, 115 together with the second feeding assembly 123 on a common holder 124, minimizes the relative movement between the inlet opening 120 and the facing end of the second feeding arrangement 123. Thus, an essentially constant angle of attack is achieved between the leading end of each bag 105' and the spindle 110 throughout the roll-forming operation. Further, relative movement is minimized between the first feeding assembly 122 and the facing end of the second feeding assembly 123, thereby minimizing changes in the flow path of separated bags 105' during the roll-forming operation.

Preferably, the speed of the belt 111 is kept essentially equal to the feed rate of the second feed assembly 123 throughout the roll forming operation, to avoid any stretch or slack in the bag 105' as it is brought into engagement between the belt 111 and the spindle 110. It is also preferred that the spindle 110 is connected to a drive means (not shown), such as a servomotor, and that the belt 111 is driven by engagement with the spindle 110. With such a driven spindle 110, each bag 105' wound onto the spindle 110 will be automatically tightened by a slight slipping action occurring between the belt 111 and the outermost bag 105' in the roll R. To maintain the speed of the belt 111 essentially equal to the feed rate of the second feed assembly 123, the rotating speed of the spindle 110 has to be reduced as the roll R is growing in diameter thereon. For example, a conventional potentiometer (not shown) could be connected to the control lever 126 to monitor the radius of the roll R, and the speed of the spindle 110 be adjusted accordingly.

Figure 4:
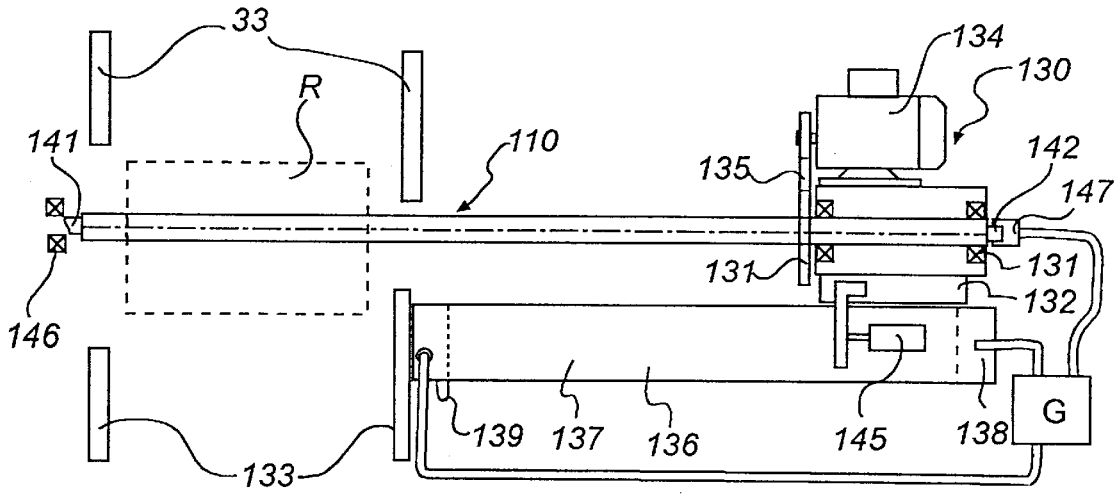
FIG. 4 is a side elevating view of the winding station in the apparatus shown in FIGS. 2–3.

An embodiment of the winding spindle 110 will be further described with reference to FIGS. 4–5. FIG. 4 is a side view of the spindle 110 and an associated driving means 130. For reasons of clarity, the belt 111 is removed, and the position of a roll R of bags is indicated with dotted lines.

The spindle 110 extends through bearings 131 mounted in a block 132, which is carried by the frame 133 of the winding station 103. An electric motor 134 is arranged on the block 132 to rotate the spindle 110 via a belt drive 135. The spindle 110 can be displaced from the roll-forming position of FIG. 4 to a discharge position (not shown) in which the roll R is positioned outside the frame 133. In the embodiment of FIG. 4, the block 132 is attached to a piston 136 enclosed in a main cylinder 137, which is connectable to a gas supply device (G). The displacement of the spindle 110 is effected by increasing the gas pressure at the respective end 138, 139 of the main cylinder 137.

The spindle 110 should preferably have a smooth and circular circumferential surface so that the belt 111, and the bags 105', can be firmly arranged around a major portion thereof. However, such a smooth surface makes it difficult to remove the finished roll R of bags, since the bags tend to adhere to the surface.

Figure 5:
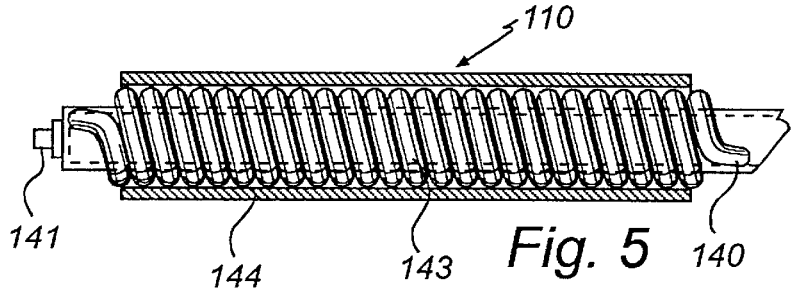
FIG. 5 is a side elevation view, partly in section, of a preferred embodiment of the winding spindle in the winding station of FIG. 4.
Figure 6:
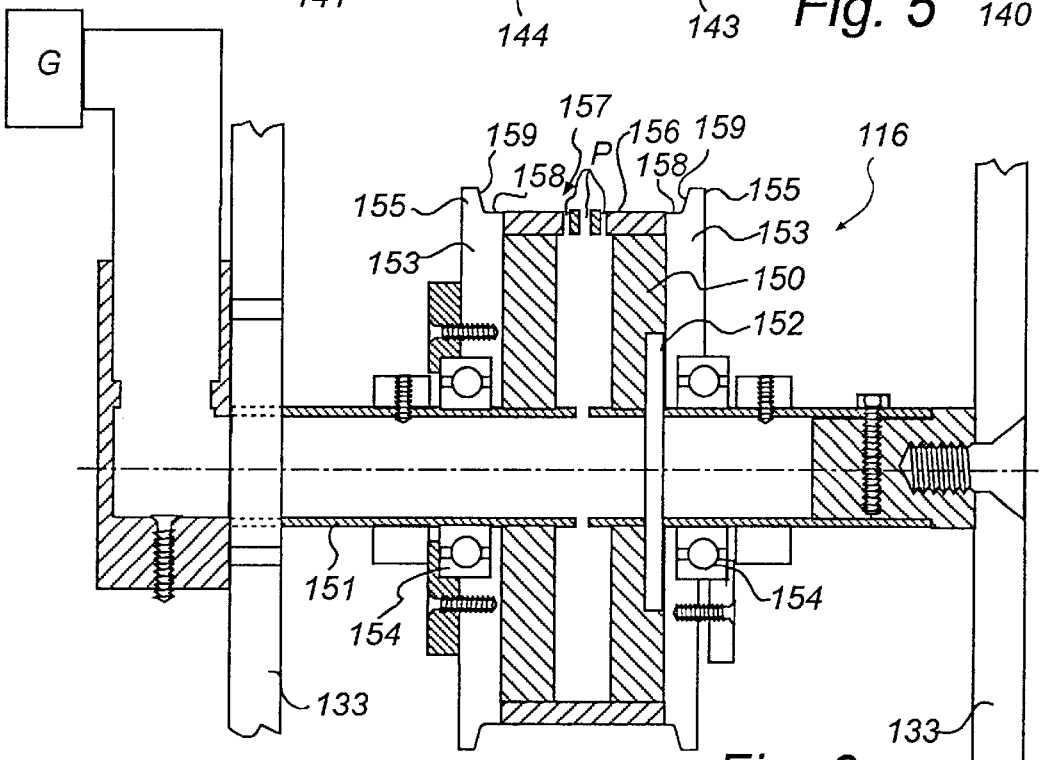
FIG. 6 is a side elevation view, partly in section, of the belt guide means in the apparatus shown in FIGS. 2–3.

This problem is solved in the embodiment shown in FIG. 5, in which the spindle 110 is essentially circular in cross section and has a variable diameter. The spindle 110 comprises an elongate hollow pipe 140, preferably of metal, the ends of which are sealed and provided with an outlet and an inlet valve 141, 142, respectively. A tube 143 of flexible material, such as a silicon material, is arranged in several turns around the periphery of the pipe 140, both ends of the flexible tube 143 being communicated with the interior of the pipe 140. A sheet 144, preferably of metal, is arranged around the turns of flexible tube 143 to provide a smooth circumferential surface. The longitudinal ends of the sheet 144 are arranged to overlap without being physically connected. Thus, by changing a gas pressure within the spindle 110, the diameter of said spindle 110 can be controlled. It is to be understood that only part of the spindle 110 needs to be provided with such a controllable diameter.

The operation of the above spindle 110 will now be described with reference to FIG. 4. When a roll-forming operation has been completed, the spindle 110 is advanced a short distance towards the discharge position, for example by means of a secondary gas-actuated piston 145 connecting the block 132 to the main cylinder 137. On advancing the spindle 110, its outlet valve 141 is engaged with a stop means 146 so that gas is released from the spindle 110, thereby decreasing its diameter. To minimize friction between the stop means 146 and the rotating spindle 110, the stop means 146 could be a rotatable device such as a bearing. Then, the stop means 146 is removed and the spindle 110 is further advanced, by pressurizing one end 138 of the main cylinder 137, to the discharge position. Due to the reduced diameter of the spindle 110, the roll R of bags is easily removed. Then, by pressurizing the opposite end 139 of the main cylinder 137, the spindle 110 is returned to the roll-forming position in which its inlet valve 142 is engaged with a connector 147 of a gas supply device (G). Thereby, the diameter of the spindle 110 is again increased before a first bag 105' is wound thereon.

Evidently, the spindle 110 can be continuously rotated during the above operation. This minimizes the wear and tear of the drive means 130 and optimizes the production speed.

When a wide belt is being driven over rollers in an endless loop, it has a tendency to move sideways on the rollers. Thus, after a few revolutions of the belt in the endless loop, the belt tends to fall off. To overcome this problem, the winding station 103 comprises a belt guide means 116, as shown in FIGS. 2–3, which will be further described with reference to FIG. 3. In the belt guide means 116, a large-diameter hollow cylinder 150 is coaxially arranged on a pipe 151 and secured against rotation by means of a key 152 extending through the pipe 151. Two gables 153 are arranged adjacent to a respective end of the cylinder 150. Each gable 153 is connected to a bearing 154 fixed to the pipe 151. The extremities 155 of the gables 153 project beyond the peripheral surface 156 of the cylinder 150, thereby forming a chute or a trench 157 in which the belt 111 is to be received. Each extremity 155 is formed to provide a first surface 158, which is level with the peripheral surface 156, and a second surface 159, which is inclined away from the first surface 158 and forms a side wall of the trench 157.

Preferably, a gas layer is provided between the belt 111 and the peripheral surface 156 of the cylinder 150. To this end, the pipe 151 is connected to a gas supply device (G) and the wall of the pipe 151 has openings communicating the interior of the pipe 151 with the interior of the cylinder 150. Further, the peripheral surface 156 is provided with holes or perforations (P), through which gas from the gas supply device is ejected.

The large-diameter cylinder 150 with journaled gables 153 effectively prevents the moving belt 111 from climbing off the cylinder 150, and provides low friction between the gables 153 and the belt 111. Friction is further reduced by the gas layer between the belt 111 and the peripheral surface 156. The cylinder 150 is preferably stationary, since this simplifies the interconnection between the pipe 151 and the cylinder 150.

It is to be understood that various alterations, modifications and/or additions may be introduced into constructions and parts previously described without departing from the spirit or ambit of the invention as defined in the following claims. For example, a bellow means can be incorporated in the spindle instead of the flexible tube to provide the desired radial expansion and contraction. Alternatively, a spring may be provided which changes its diameter on elongation and compression. It should also be understood that a plurality of narrow belts could be used instead of a single wide belt.

What I claim and desire to secure by Letters Patent is:

1. An apparatus for producing a roll of bags, in which bags are wound into a roll without being connected to one another, said apparatus comprising a feeding means and a winding station which is disposed to receive said bags from the feeding means, said winding station including a rotating spindle which is arranged to engage with said bags and produce said roll of bags, and said feeding means being arranged to feed said bags one by one to said spindle, said apparatus further comprising at least two winding stations, each winding station being connected to a feeding means, and a switch means which is arranged upstream of said feeding means to direct said bags from one winding station to the other when a roll has been completed in said one winding station, and wherein said switch means comprises a wedge, the tip of which is directed towards said separation unit, said wedge being rotatable such that its tip is moved sideways to guide the flow of separated bags from said separation unit to one of said winding stations.

2. An apparatus as set forth in claim 1, wherein said winding station comprises an abutment means which is abuttingly arranged on a major portion of the periphery of said rotating spindle, and wherein said bags received from said feeding means are engaged between said abutment means and the periphery of the spindle.

3. An apparatus as set forth in claim 2, wherein said abutment means comprises at least one movable endless belt which is arranged to partly encircle said spindle.

4. An apparatus as set forth in claim 3, wherein said winding station includes a guide means arranged to guide said belt during movement thereof.

5. An apparatus for producing a roll of bags, in which bags are wound into a roll without being connected to one another, said apparatus comprising a feeding means and a winding station which is disposed to receive said bags from the feeding means, said winding station including a rotating spindle which is arranged to engage with said bags and produce said roll of bags, said feeding means being arranged to feed said bags one by one to said spindle, said apparatus further comprising at least two winding stations, each winding station being connected to a feeding means, and a switch means which is arranged upstream of said feeding means to direct said bags from one winding station to the other when a roll has been completed in said one winding station, said apparatus further comprising a separation device arranged to separate said bags from a continuous web of bag material having perforations in the boundary between adjacent bags, wherein said separation device includes a first driven pair of rollers for feeding the web, and an engagement means which is arranged upstream of said first pair of rollers, in the feeding direction of the web, and is operable to at least intermittently engage the web to thereby separate a bag therefrom, and wherein the distance between the engagement means and said first pair of rollers is adjustable to exceed the mutual distance between successive perforations in said web.

6. An apparatus for producing a roll of bags, in which bags are wound into a roll without being connected to one another, said apparatus comprising a feeding means and a winding station which is disposed to receive said bags from the feeding means, said winding station including a rotating spindle which is arranged to engage with said bags and produce said roll of bags, said feeding means being arranged to feed said bags one by one to said spindle, said apparatus further comprising at least two winding stations, each winding station being connected to a feeding means, and a switch means which is arranged upstream of said feeding means to direct said bags from one winding station to the other when a roll has been completed in said one winding station, and wherein said winding station comprises an abutment means which is abuttingly arranged on a major portion of the periphery of said rotating spindle, and wherein said bags received from said feeding means are engaged between said abutment means and the periphery of the spindle, wherein said abutment means comprises at least one movable endless belt which is arranged to partly encircle said spindle, wherein said winding station includes a guide means arranged to guide said belt during movement thereof, and wherein said belt guide means comprises a body defining a trench having the shape of an arc, said belt being received in said trench, and wherein perforations are provided in a bottom surface of said trench, said perforations being connected to a gas supply device to provide a gas layer between the belt and the bottom surface.

7. A method of producing a roll of bags with an apparatus for producing a roll of bags, in which apparatus bags are wound into a roll without being connected to one another, said apparatus comprising a feeding means and a winding station which is disposed to receive said bags from the feeding means, said winding station including a rotating spindle which is arranged to engage with said bags and produce said roll of bags, and said feeding means being arranged to feed said bags one by one to said spindle, and said apparatus further comprising at lest two winding stations, each winding station being connected to a feeding means, and a switch means which is arranged upstream of said feeding means to direct said bags from one winding station to the other when a roll has been completed in said one winding station, and wherein the method comprises:

winding bags into the roll without being connected to one another, and said bags being fed one by one to the rotating spindle and are wound thereon, and wherein a leading end of each bag is fed into engagement between the periphery of said rotating spindle and a moving belt, which encircles a major portion of the periphery of said spindle, and wherein said belt is formed as an endless loop, and said belt is guided over a gas cushion provided in a trench having the shape of an arc.

8. An apparatus for producing a roll of bags, in which bags are wound into a roll without being connected to one another, said apparatus comprising a feeding means and a winding station which is disposed to receive said bags from the feeding means, said winding station including a rotating spindle which is arranged to engage with said bags and produce said roll of bags, characterized in that said feeding means is arranged to feed said bags one by one to said spindle;

said apparatus further comprising a separation device arranged to separate said bags from a continuous web of bag material having perforations in the boundary between adjacent bags;

wherein said separation device includes a first driven pair of rollers for feeding the web, and an engagement means which is arranged upstream of said first pair of rollers, in the feeding direction of the web, and is operable to at least intermittently engage the web to thereby separate a bag therefrom; and wherein the distance between the engagement means and said first pair of rollers is adjustable to exceed the mutual distance between successive perforations in said web.

9. An apparatus for producing a roll of bags, in which bags are wound into a roll without being connected to one another, said apparatus comprising a feeding means and a winding station which is disposed to receive said bags from the feeding means, said winding station including a rotating spindle which is arranged to engage with said bags and produce said roll of bags, characterized in that said feeding means is arranged to feed said bags one by one to said spindle;

wherein said winding station comprises an abutment means which is abuttingly arranged on a major portion of the periphery of said rotating spindle, and wherein said bags received from said feeding means are engaged between said abutment means and the periphery of the spindle;

wherein said abutment means comprises at least one movable endless belt which is arranged to partly encircle said spindle;

wherein said winding station includes a guide means arranged to guide said belt during movement thereof; and wherein said belt guide means comprises a body defining a trench having the shape of an arc, said belt being received in said trench, and wherein perforations are provided in a bottom surface of said trench, said perforations being connected to a gas supply device to provide a gas layer between the belt and the bottom surface.

10. An apparatus as set forth in claim 9, further comprising a separation device arranged to separate said bags from a continuous web of bag material having perforations in the boundary between adjacent bags.

11. An apparatus as set forth in claim 10, wherein said separation device includes a first driven pair of rollers for feeding the web, and an engagement means which is arranged upstream of said first pair of rollers, in the feeding direction of the web, and is operable to at least intermittently engage the web to thereby separate a bag therefrom.

12. An apparatus as set forth in claim 11, wherein said engagement means includes a second driven pair of rollers for feeding the web, and wherein a web feed rate of said first pair of rollers exceeds a web feed rate of said second pair of rollers.

13. An apparatus as set forth in claim 11, wherein said feeding means comprises at least one driven pair of rollers for feeding a bag to said spindle, and wherein a bag feed rate of said pair of rollers essentially corresponds to a web feed rate of said first pair of rollers of said separation means.

14. An apparatus as set forth in claim 9, wherein said abutment means extends over at least ⅔ of the periphery of the spindle.

15. An apparatus as set forth in claim 9, wherein said abutment means is arranged to apply essentially constant force on the roll of bags during formation thereof on the periphery of the spindle.

16. An apparatus as set forth in claim 9, wherein said belt is driven at an essentially constant speed.

17. An apparatus as set forth in claim 9, wherein said belt is driven by engagement with said spindle.

18. An apparatus as set forth in claim 9, wherein said bottom surface is formed on a peripheral portion of a cylinder which is fixedly connected to a support of said winding station, and wherein two opposite wall surfaces of said trench are formed by portions of gables which are arranged at opposite ends of said cylinder.

19. An apparatus as set forth in claim 18, wherein said gables are journaled for free rotation relative to said cylinder.

20. An apparatus as set forth in claim 9, wherein said winding station comprises a haul-in means arranged to engage a leading end of a bag with said rotating spindle.

21. An apparatus as set forth in claim 20, wherein a first belt backup roller is arranged against said belt upstream of the rotating spindle, as seen in the direction of belt movement, and a second belt backup roller is arranged against said belt downstream of the rotating spindle, said backup rollers guiding said belt around said rotating spindle, and wherein the belt, in a region between the first belt backup roller and the spindle, forms a bag haul-in means of said winding station.

22. An apparatus as set forth in claim 20, wherein at least part of said feeding means is movable relative to said winding station such that, during formation of a roll of bags on the spindle, an essentially constant angle of attack is achieved between a leading end of a bag fed thereto and said haul-in means.

23. An apparatus as set forth in claim 21, wherein said second belt backup roller has a smaller diameter and is arranged closer to said rotating spindle than said first belt backup roller.

24. An apparatus as set forth in claim 21, wherein said first and second belt backup rollers and at least part of said feeding means are arranged at a fixed mutual distance on a movable element, an essentially constant distance being maintained between said element and said roll of bags during formation thereof.

25. An apparatus as set forth in claim 9, wherein said rotating spindle is essentially circular in cross section and has a variable diameter.

26. An apparatus as set forth in claim 25, wherein said spindle has an interior chamber which is connected to a gas supply device, and wherein the diameter of said spindle is varied by changing a gas pressure in said chamber.

27. An apparatus as set forth in claim 26, wherein said spindle comprises an elongate body, a tube means of flexible material arranged in a number of turns around said body, and a protective sheet covering said tube means and forming a periphery of said spindle.

28. A method of producing a roll of bags with the apparatus of claim 9, wherein bags are wound into the roll without being connected to one another, and in that said bags are fed one by one to the rotating spindle and are wound thereon.

29. A method as set forth in claim 28, wherein one of said bags is fully wound onto said spindle before another one of said bags is engaged with said spindle.

30. A method as set forth in claim 28, wherein a leading end of each bag is fed into engagement between the periphery of said rotating spindle and a moving belt, which encircles a major portion of the periphery of said spindle.

31. A method as set forth in claim 30, wherein said belt forms a bag haul-in means which brings said leading end of each bag into engagement with said spindle, said leading end being fed at an essentially constant angle of attack to said haul-in means during formation of said roll of bags on the spindle.

32. A method as set forth in claim 30, wherein said rotating spindle drives said belt at an essentially constant speed.

33. A method as set forth in claim 28, wherein said trench is defined by a bottom surface and opposite side walls, said side walls being freely movable relative to said bottom surface.

34. A method as set forth in claim 30, wherein the tension of said belt is adjusted such that an essentially constant force is applied on the roll of bags being formed between the belt and the periphery of said spindle.

35. A method as set forth in claim 28, wherein the diameter of said spindle is decreased when a roll of bags has been formed thereon, to allow for removal of said roll of bags.

36. A method as set forth in claim 28, wherein said bags is produced by feeding a continuous web of bag material, which has perforations in the boundary between adjacent bags, at a web in-feed rate to engagement with a driven pair of rollers having a feed rate that exceeds said web in-feed rate, thereby separating a bag from said web and providing a spacing thereto.

* * * * *